US006145947A

United States Patent [19]

Inora et al.

[11] Patent Number: 6,145,947

[45] Date of Patent: Nov. 14, 2000

[54] INK CONSUMPTION DETECTION METHOD AND SYSTEM

[75] Inventors: Masaru Inora; Hideyuki Kobayashi, both of Niigata, Japan

[73] Assignee: NEC Corporation

[21] Appl. No.: 09/104,293

[22] Filed: Jun. 24, 1998

[30] Foreign Application Priority Data

Jun. 25, 1997 [JP] Japan ..... 9-168836

[51] Int. Cl.[7] ..... B41J 2/175

[52] U.S. Cl. ..... 347/7; 399/25

[58] Field of Search ..... 347/7, 19, 12, 347/13; 399/25, 27; 358/1.16

[56] References Cited

U.S. PATENT DOCUMENTS

| | | | |
|---|---|---|---|
| 4,233,663 | 11/1980 | Sugawara et al. | 358/296 |
| 5,202,769 | 4/1993 | Suzuki . | |
| 5,592,298 | 1/1997 | Caruso | 358/298 |
| 5,610,635 | 3/1997 | Murray et al. | 347/7 |
| 5,663,750 | 9/1997 | Sakuma | 347/7 |
| 5,680,521 | 10/1997 | Pardo et al. | 395/112 |
| 5,724,627 | 3/1998 | Tanaka et al. . | |

FOREIGN PATENT DOCUMENTS

| | | |
|---|---|---|
| 0593282 | 4/1994 | European Pat. Off. . |
| 1-195049 | 8/1989 | Japan . |
| 3-193356 | 8/1991 | Japan . |
| 3-246058 | 11/1991 | Japan . |
| 4-74683 | 3/1992 | Japan . |
| 4-147169 | 5/1992 | Japan . |
| 4-316856 | 11/1992 | Japan . |
| 8-34123 | 2/1996 | Japan . |
| 9-156125 | 6/1997 | Japan . |
| 2311437 | 9/1997 | United Kingdom . |

OTHER PUBLICATIONS

Japanese Office Action issued 3/21/00 in a related application and English translation of relevant portions.

Patent Abstracts of Japan, vol. 008, No. 22 (M–272), Jan. 31, 1984 & JP 58–181680 A (Dainippon Insatsu KK), Oct. 24, 1983, *abstract*.

European Search Report (in English) issued May 8, 2000 in a related application.

Patent abstracts of Japan, vol. 008, No. 022 (M–272), Jan. 31, 1984 & JP 58–181680 A (Dainippon Insatsu KK), Oct. 24, 1983, *abstract*.

*Primary Examiner*—John Barlow
*Assistant Examiner*—Craig A. Hallacher
*Attorney, Agent, or Firm*—Ostrolenk, Faber, Gerb & Soffen, LLP

[57] ABSTRACT

In an inkjet printer, print image data indicating a pattern of ejection and non-ejection nozzles is produced from print data received from a host computer and the print image data is searched in blocks for an effective block including data indicating at least one ejection nozzle to count effective blocks, wherein a block has a predetermined size. Ink consumption caused by a print operation is detected based on a count of the effective blocks.

18 Claims, 7 Drawing Sheets

INK CONSUMPTION DETECTION METHOD AND SYSTEM

BACKGROUND OF THE INVENTION

1. Field of the Invention

The present invention generally relates to an inkjet printing system, and in particular to an ink consumption detection method and system for an inkjet printer.

2. Description of the Related Art

An inkjet printer is provided with a print head having an array or nozzles which selectively eject ink to form a pattern of dots on the printing medium depending on print data. Since the ink is stored in an ink reservoir, it is important to check the ink level of the ink reservoir to avoid deterioration of print quality.

A conventional ink level check apparatus has been disclosed in Japanese Patent Unexamined Publication No. 4-316856. According to the conventional apparatus, each time ink suction is performed for nozzle cleaning, the amount of suctioned ink is represented on the basis of the number of dots. The number of dots corresponding to the amount of suctioned ink is added to the number of printed dots which were actually printed for one line. The ink level of the ink reservoir is checked by calculating a ratio of the total number of actually-printed and represented dots to the possible number of dots corresponding to the full capacity of the ink reservoir.

However, the dot count process forms an increasing proportion of the print control process as the resolution of the printer increases. Therefore, the interval from the time the print of the previous line is ended to the time the current line is started becomes longer, resulting in reduced speed of printing.

Further, only the amount of suctioned ink is counted. Therefore, the reliability of the ink level check is not enough. If all operations leading to ink consumption are taken into account, the dot count process would cause the speed of printing to be further reduced.

SUMMARY OF THE INVENTION

An object of the present invention is to provide a method and system which can detect ink consumption with improved print speed.

Another object of the present invention is to provide a method and system which can achieve reliable ink consumption detection.

According to one aspect of the present invention, in an inkjet printer having a print head with a plurality of nozzles selectively ejecting ink to a printing medium, after producing print image data indicating a pattern of ejection and non-ejection nozzles, the print image data is searched in blocks for an effective block including data indicating at least one ejection nozzle to count effective blocks, wherein a block has a predetermined size. Ink consumption caused by a print operation is detected based on a count of the effective blocks.

According to another aspect of the present invention, an inkjet printer includes a print head having a plurality of nozzles selectively ejecting ink to a printing medium, a memory for storing an ink consumption count value corresponding to an ink consumption operation of the inkjet printer, and a controller for producing print image data indicating a pattern of ejection and non-ejection nozzles, searching the print image data in blocks for an effective block including data indicating at least one ejection nozzle to count effective blocks, wherein a block has a predetermined size, and detecting ink consumption caused by a print operation based on a count of the effective blocks.

Since ink consumption is obtained by counting the number of effective blocks, the print control can be performed without burdening the controller with the ink consumption detection, resulting in improved print speed.

In addition to the print operation, an ink suction operation for suctioning ink from the nozzles and an ink pre-ejection operation for ejecting ink from the nozzles before printing may be included. In this case, since total ink consumption is obtained by summing the respective ink consumption count values of nozzle suction, pre-ejection and print operations, the accurate amount of ink consumption is obtained, resulting in a reliable ink level check.

DETAILED DESCRIPTION OF THE PREFERRED EMBODIMENTS

Figure 1:
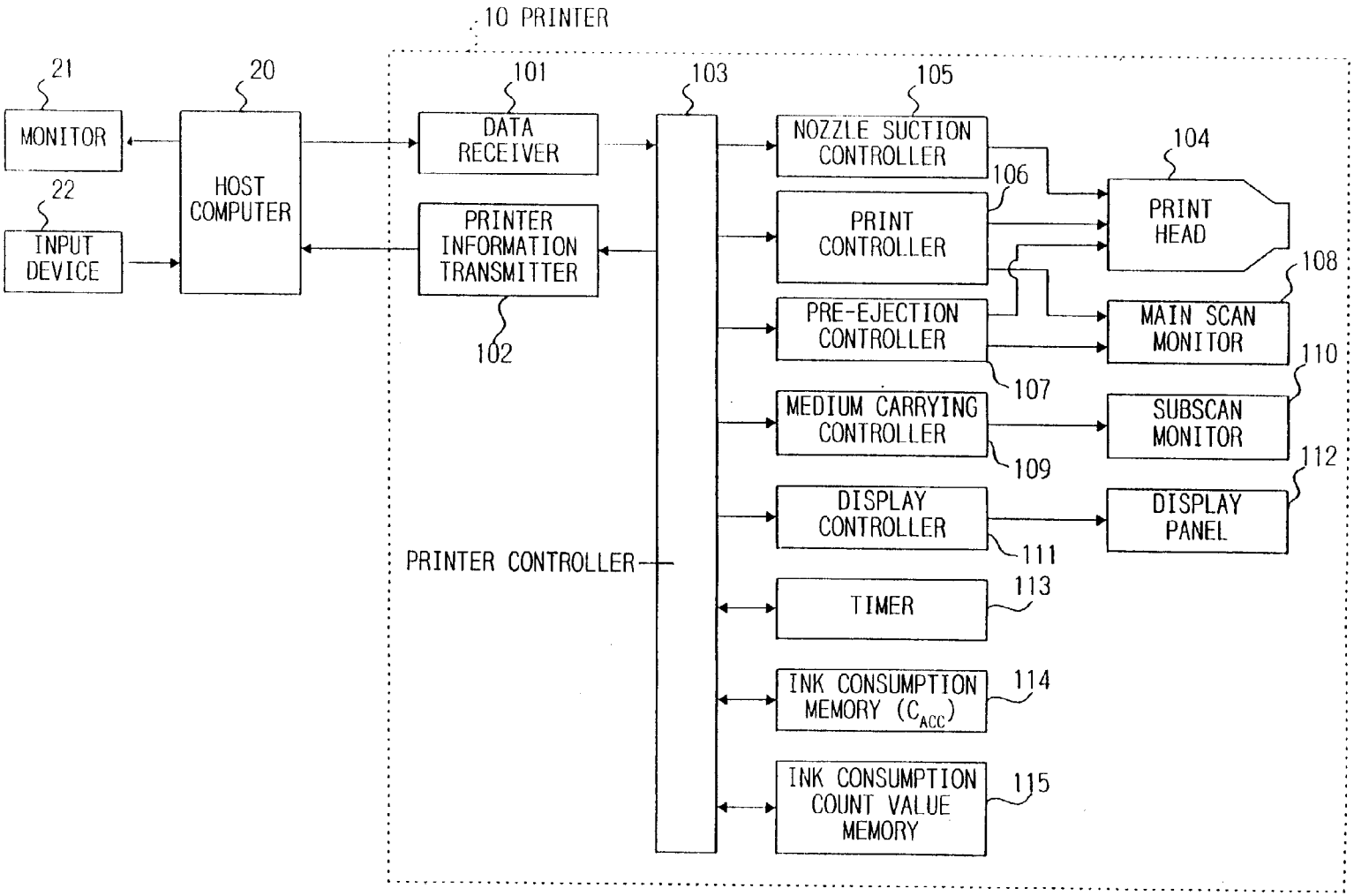
FIG. 1 is a block diagram showing the circuit configuration of an inkjet printer according to an embodiment of the present invention.

Referring to FIG. 1, there is shown an inkjet printing system which is comprised of an inkjet printer 10 and a host computer 20 having a monitor 21 and an input device 22 connected thereto. The printer 10 includes a data receiver 101 and a printer information transmitter 102 which are used to communicate with the host computer 20. The print data and necessary commands are transferred from the host computer 20 to a printer controller 103 through the data receiver 101. Contrarily, printer information including ink level or ink consumption data are transferred from the printer controller 103 to the host computer 20 through the printer information transmitter 102. The printer controller 103 controls the operations of the printer 10 as will be described later.

The printer 10 is equipped with a print head 104 which is detachably provided on a carriage (not shown). The print head 104 is controlled by a nozzle suction controller 105, a print controller 106 and a pre-ejection controller 107 which are controlled by the printer controller 103. The nozzle suction controller 105 controls a suction operation of the nozzles of the print head for nozzle cleaning. The print controller 106 controls ink ejection of the nozzles according to print data. The print head 104 may use piezoelectric devices or heaters. The pre-ejection controller 107 controls pre-ejection operation of the nozzles. Since the operations of suction, printing and pre-ejection, each consume ink, the ink consumption is counted by using an ink consumption counter $C_{ACC}$ for each operation as described later.

The carriage carrying the print head 104, which may also carry an ink cartridge, performs a reciprocating motion in a main scan direction by a main scanning motor 108 which is controlled by the print controller 106 and the pre-ejection controller 107. Therefore, the print head 104 ejects ink from one or more nozzles selected according to the print data while performing the reciprocating motion.

A medium carrying controller 109 controls a subscan motor 110 which carries a printing medium in a subscan direction orthogonal to the main scan direction under the control of the print controller 103. A display controller 111 controls a display panel 112 under the control of the printer controller 103.

Further, the printer controller 103 uses a timer 113 as a time measurement means to measure a predetermined time period. Furthermore, the printer controller 103 is connected to an ink consumption memory 114 and an ink consumption count value memory 115. The ink consumption memory 114 stores an ink consumption counter $C_{ACC}$ which is used to determine the total ink consumption. The ink consumption count value memory 115 previously stores predetermined count values corresponding to the suction, print and pre-ejection operations, respectively. For example, an ink consumption of 1 gram corresponds to a count value of $2\times10^7$ and the count value is proportional to the weight of ink consumption. The printer controller 103 converts the ink consumption caused by such an operation into the corresponding count value and counts the total ink consumption using the ink consumption counter $C_{ACC}$ as will be described later.

In addition, the printer 10 is provided with a printing medium sensor which is arranged for detecting the presence and absence of a printing medium, but is not shown in FIG. 1 for simplicity.

Figure 2:
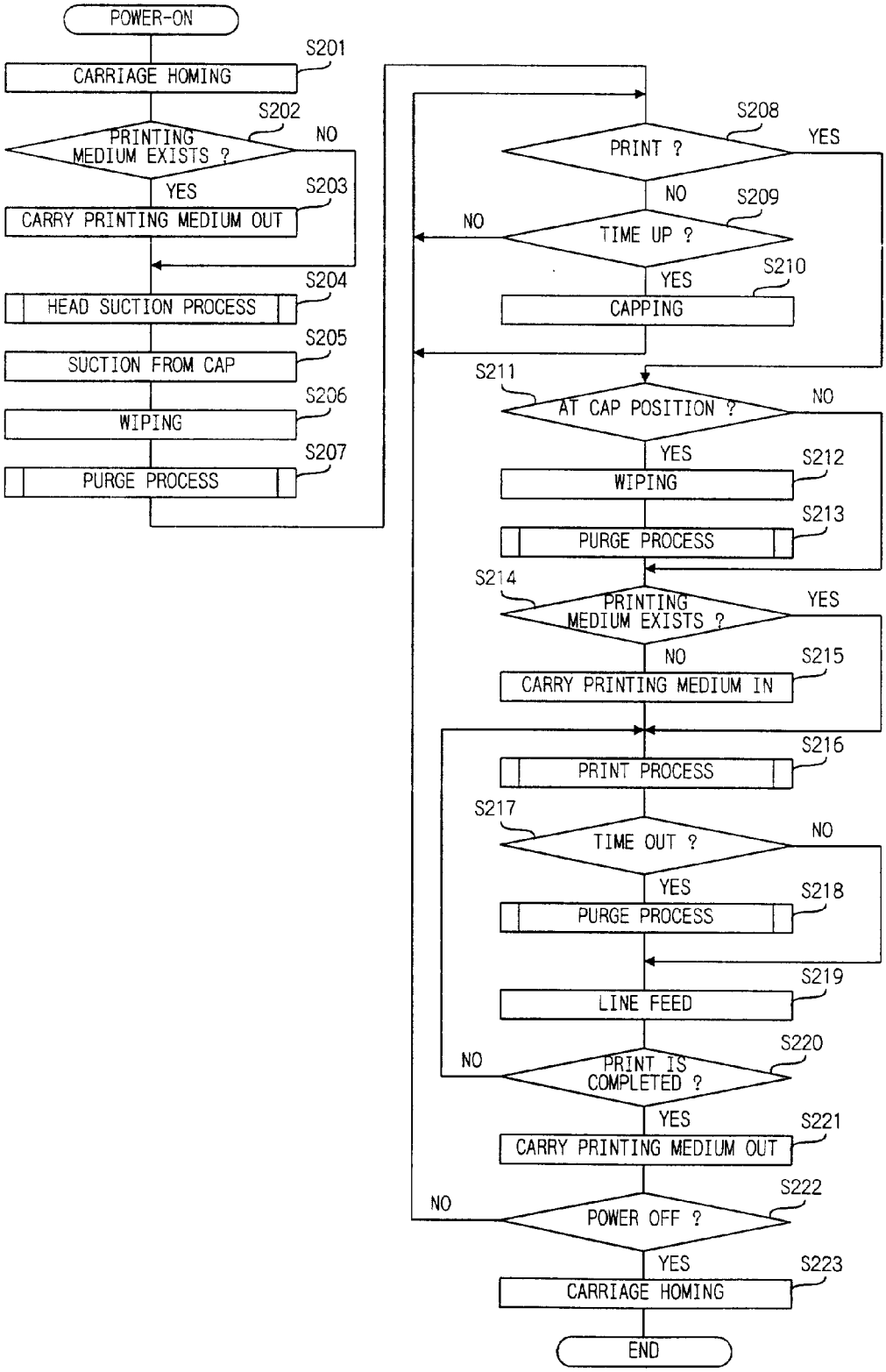
FIG. 2 is a flow chart showing a main control flow of the embodiment.

Referring to FIG. 2, when the printer is powered on, the carriage carrying the print head 104 and the ink cartridge is moved to a home position (step S201). When the printing medium sensor detects the presence of a printing medium (step S202), the medium carrying controller 109 instructs the subscan motor 110 to carry the printing medium out (step S203).

At the home position, the nozzle surface of the print head 104 is capped with a cap by moving the carriage in the direction opposite to the print area of the printing medium. Here, ink is suctioned from the nozzles for cleaning by the nozzle suction controller 105 (step S204). After the nozzle suction operation, the suctioned ink is in turn suctioned from the cap and then discharged in a discharge reservoir (step S205).

Subsequently, the pre-ejection controller 107 controls the main scan motor 108 so that the carriage is moved to the printing direction and thereby the nozzle surface of the print head 104 is wiped (hereinafter, called a wiping operation) (step S206). Thereafter, the pre-ejection controller 107 performs a purge process by which the nozzles of the print head 104 eject ink to the discharge reservoir for removing dried ink from the nozzles (step S207). In this manner, the initial operation is performed.

After the above initial operation has been completed, the printer controller 103 determines whether a print command is received (step S208). If no print command is received for a predetermined time period (steps S208 and S209), the nozzles of the print head 104 are capped with the cap to prevent them from drying under the control of the pre-ejection controller 107 (step S210).

When the print command is received and the above capping operation is performed (YES in steps S208 and S211), the wiping operation (step S212) and the purge operation (step S213) are sequentially performed. After the step S213 has been completed or when the above capping operation is not performed at that time (NO in step S211), the printer controller 103 determines whether the printing medium sensor detects the presence of a printing medium (step S214). When there in no printing medium (NO is step S214), the medium carrying controller 109 instructs the subscan motor 110 to carry the printing medium in (step S215).

After the printing medium is prepared, a page print operation is performed (steps S216–S220). More specifically, the print controller 106 controls the print head 104 and the main scan motor 108 so as to print a line of print image data (step S216). The timer 113 determines whether a predetermined time period has elapsed since the print start time (step S217). When the predetermined time period has elapsed, the purge process is performed (step S218) and then a line feed is performed by the medium carrying controller 109 controlling the subscan motor 110 (step S219). If the page print is not completed (NO in step S220), the steps S216–S220 are repeated performed until the page print has been completed. Therefore, the purge process (step S218) is performed at regular intervals during the print operation. In the case where the timer 113 is set for 10 seconds, the purge process (step S218) is performed at intervals of 10 seconds.

When the page has been printed (YES in step S220), the printing medium is carried out by the medium carrying controller controlling the subscan motor 110 (step S221) and then the above steps S208–S221 are repeatedly performed until powering off (YES in step S222). When powered off, the carriage is moved to the home position and the nozzles are capped with the cap to prevent them from drying (step S223). The details of each process will be described hereinafter.

HEAD SUCTION PROCESS

Figure 3:
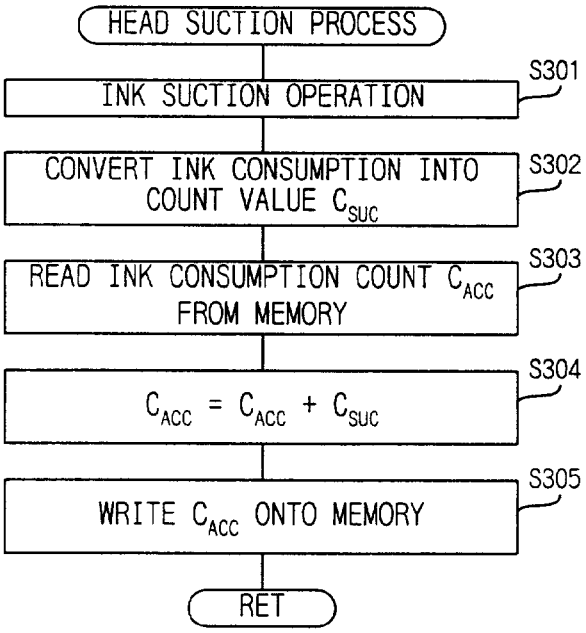
FIG. 3 is a flow chart showing a suction process of the embodiment.

Referring to FIG. 3, when the ink suction is performed for cleaning by the nozzle suction controller 105 (step S301), the printer controller 103 reads a suction count value $C_{SUC}$ from the memory 115 and converts the ink consumption caused by the suction operation into the suction count value $C_{SUC}$ (step S302). Thereafter, the printer controller 103 reads the ink consumption counter $C_{ACC}$ from the memory 114 (step S303) and adds the suction count value $C_{SUC}$ to the ink consumption counter $C_{ACC}$ to produce an updated ink consumption counter $C_{ACC}$ (step S304). The updated ink consumption counter $C_{ACC}$ is written onto the memory 114 (step S305).

More specifically, assuming that an ink consumption caused by the suction operation is 0.5 gram in weight, it is converted to the suction count value $C_{SUC}=1\times10^7=10{,}000{,}000$. If the ink consumption counter $C_{ACC}$ is zero at that time, an updated ink consumption counter $C_{ACC}=C_{ACC}|C_{SUC}=10{,}000{,}000$ is restored onto the memory 114.

PURGE PROCESS

Figure 4:
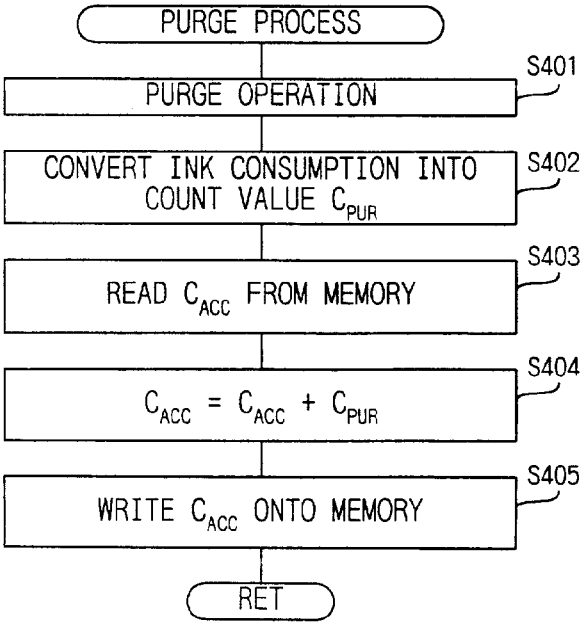
FIG. 4 is a flow chart showing a purge process of the embodiment.

Referring to FIG. 4, when the pre-ejection controller 107 performs a purge process by which the nozzles of the print head 104 eject ink to the discharge reservoir for removing dried ink from the nozzles (step S401), the printer controller 103 reads a purge count value $C_{PUR}$ from the memory 115 and converts the ink consumption caused by the purge operation into the purge count value $C_{PUR}$ (step S402). Thereafter, the printer controller 103 reads the ink consumption counter $C_{ACC}$ from the memory 114 (step S403) and adds the purge count value $C_{PUR}$ to the ink consumption counter $C_{ACC}$ to produce an updated ink consumption counter $C_{ACC}$ (step S404). The updated ink consumption counter $C_{ACC}$ is written onto the memory 114 (step S405).

More specifically, assuming that an ink consumption caused by the purge operation is $2.1\times10^7$ gram in weight, it is converted to the purge count value $C_{PUR}$=7. If the ink consumption counter $C_{ACC}$=10,000,000 at that time, an updated ink consumption counter $C_{ACC}=C_{ACC}+C_{SUC}$=10,000,007 is restored onto the memory 114.

PRINT PROCESS

Figure 5:
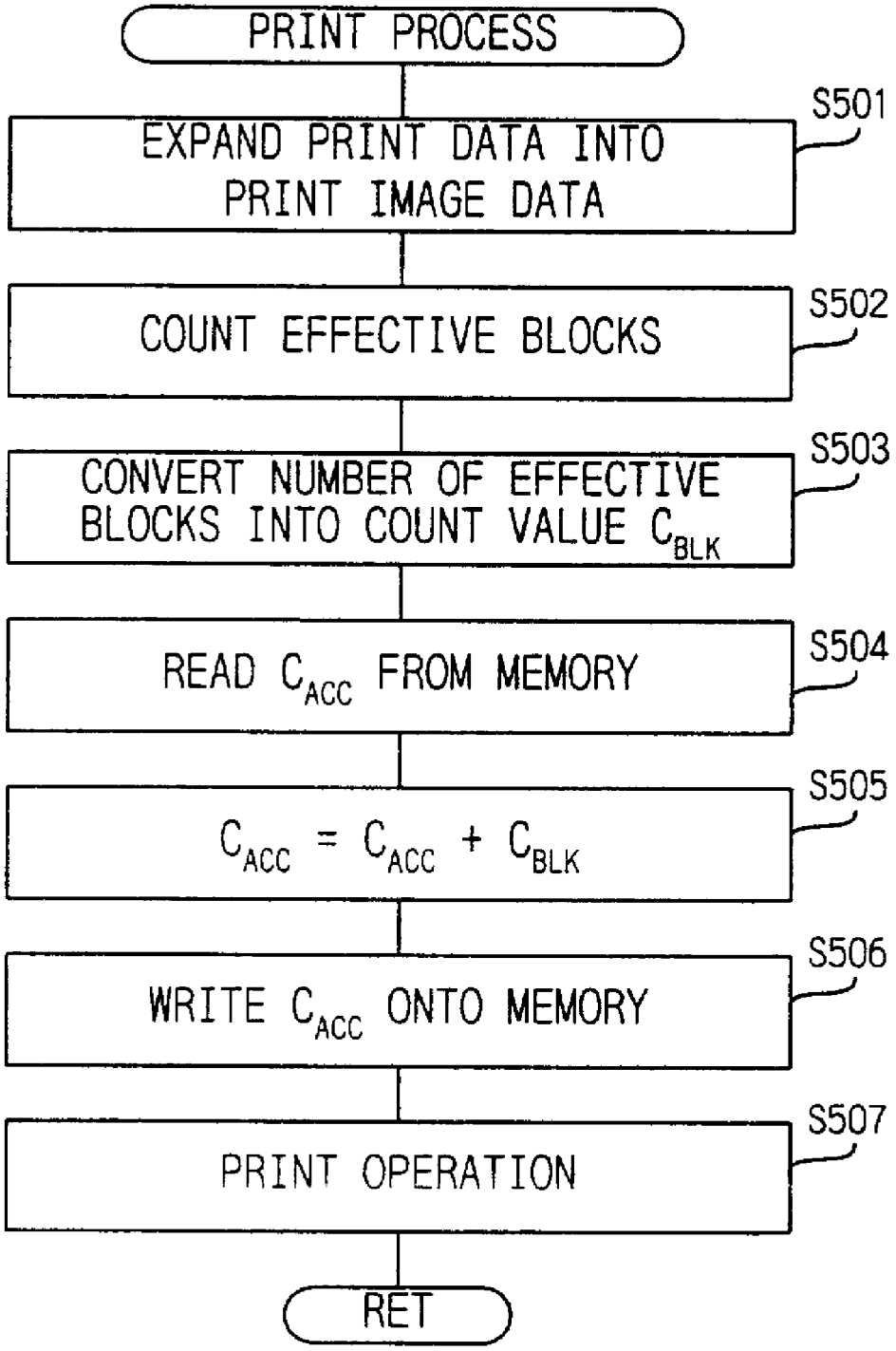
FIG. 5 is a flow chart showing a print process of the embodiment.

Referring to FIG. 5, when receiving print data from the host computer 20, the printer controller 103 expands the print data into print image data, with each bit indicating an ejection or non-ejection nozzle, and stores them onto a line buffer (step S501). Thereafter, the printer controller 103 divides the print image data of the line buffer into a plurality of clot blocks each having a predetermined dot matrix. Then, the printer controller 103 determines whether each block includes at least one ejection dot and, if included, that block is an effective block. The ink consumption of each effective block is set to a predetermined count value. In this manner, the number of effective blocks are calculated (step S502).

The printer controller 103 converts the number of effective blocks into the print count value $C_{BLK}$ (step S503). Thereafter, the printer controller 103 reads the ink consumption counter $C_{ACC}$ from the memory 114 (step S504) and adds the print count value $C_{BLK}$ to the ink consumption counter $C_{ACC}$ to produce an updated ink consumption counter $C_{ACC}$ (step S505). The updated ink consumption counter $C_{ACC}$ is written onto the memory 114 (step S506) and then the print operation is started (step S507).

Figure 6:
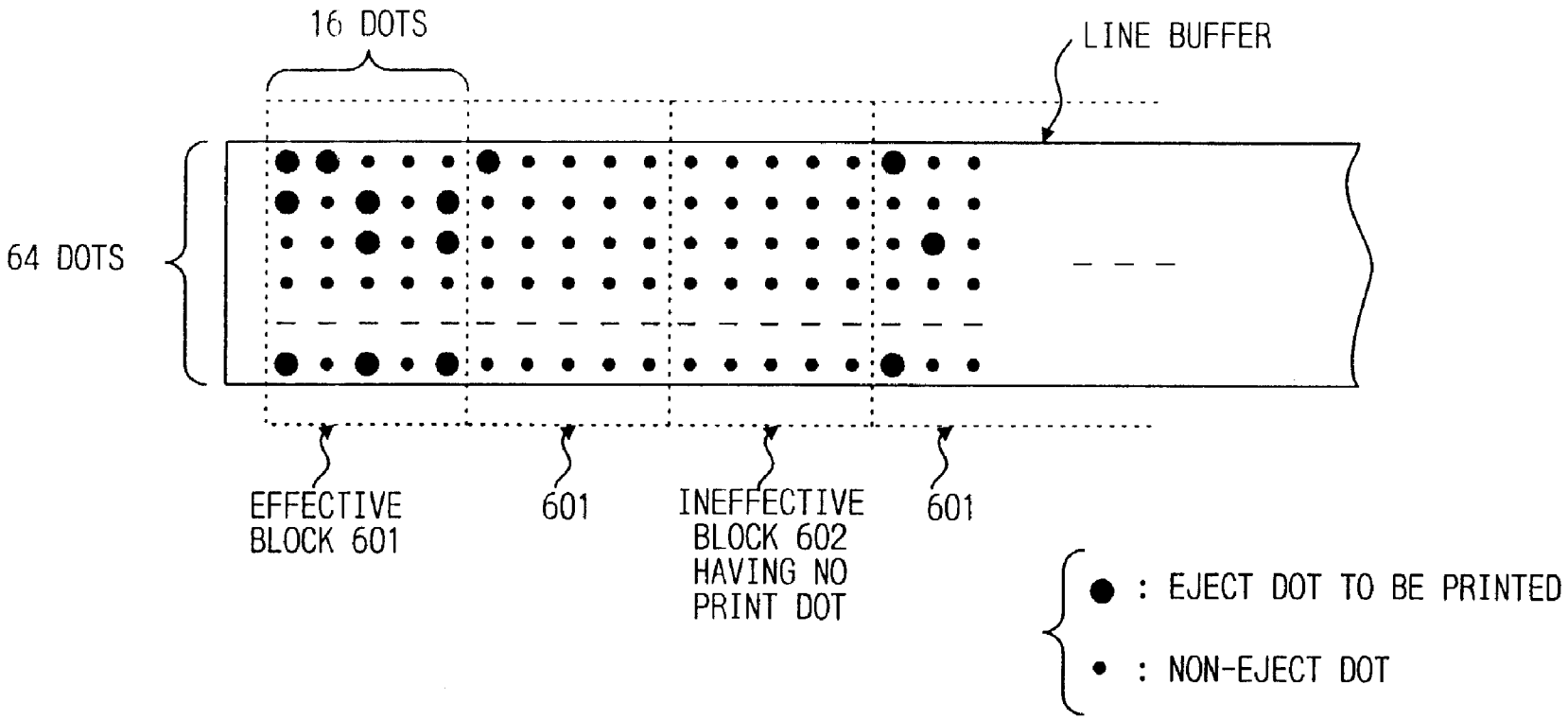
FIG. 6 is a diagram showing a block count operation of extended print image data according to the embodiment.

Referring to FIG. 6, the print image data each bit indicating ejection or non-ejection nozzle are stored onto the line buffer. In the case of monochrome ink, one block is set to a 16×64-dot matrix. In this case, the print image data as shown in FIG. 6 are searched in blocks for an effective block 601 including at least one ejection dot to count the number of effective blocks.

More specifically, the print image data, as shown in FIG. 6, is divided into a plurality of blocks each having 16×64 dots. Effective blocks 601 including at least one ejection dot are counted and ineffective blocks 602 including no ejection dot are not counted. In the case where the ink consumption of each effective block is set to $3\times10^{-8}$ gram in weight, the print count value for each effective block may be set to 1. In the case of color ink (Magenta, Yellow, and Cyan), one block is set to a 16×16-dot matrix and the ink consumption of each effective block is set to $1\times10^{-8}$ gram in weight. It should be noted that the ink consumption of each effective block is set to a predetermined count value which may be an average value varying from print head to print head.

In the case where the print count value for each effective block is set to 1 and 50 effective blocks are included, the printer controller 103 converts the total ink consumption caused by the print operation into the print count value $C_{BLK}=1\times50=50$. If the ink consumption counter $C_{ACC}$=10,000,007 at that time, an updated ink consumption counter $C_{ACC}=C_{ACC}+C_{BLK}$=10,000,057 is restored onto the memory 114.

INK LEVEL DETERMINATION

The ink level determination may be performed by either the printer 10 or the host computer 20. The ink level is determined based on the ink consumption counter $C_{ACC}$ stored in the memory 114 and the cartridge count value $C_{MAX}$ corresponding to the capacity of the ink cartridge. Since the ink level determination is performed in response to a request received from the host computer 20, the communication with the host computer 20 is asynchronous to the operation of the printer 10.

Figure 7A:
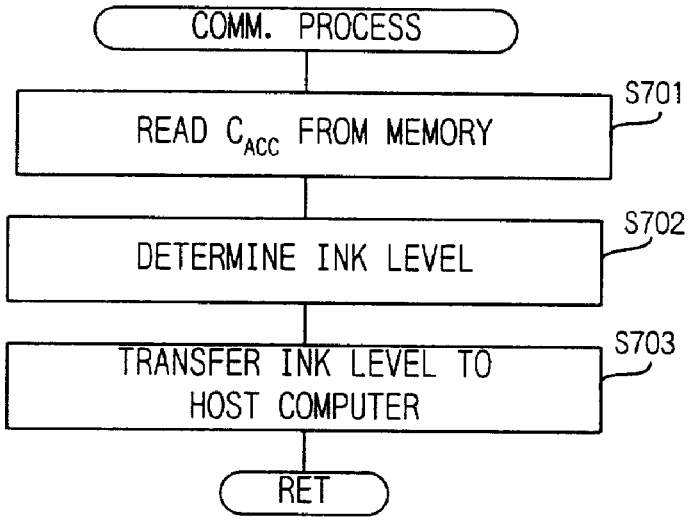
FIG. 7A is a flow chart showing a communication process of the embodiment.

Referring to FIG. 7A, when receiving a printer information request from the host computer 20, the printer controller 103 reads the ink consumption counter $C_{ACC}$ from the memory 114 (step S701) and then determines the ink level by comparing the ink consumption counter $C_{ACC}$ and the cartridge count value $C_{MAX}$ (step S702). And the ink level such as a ratio is transferred to the host computer 20 (step S703).

In the case where the capacity of a monochrome ink cartridge is 45 gram in weight corresponding to the cartridge count value $C_{MAX}=1.5\times10^9$=1,500,000,000 and the updated ink consumption counter $C_{ACC}$=30,000,000 is stored in the memory 114, the ink level is calculated by, for example, $1-C_{ACC}/C_{MAX}$=0.98, that is, the ratio of the remaining quantity is 98%. Alternatively, several levels, for example, one-third empty, two-thirds empty, and near-empty may be used as the ink level. It is the same with the case where the capacity of each color ink cartridge is 15 gram in weight corresponding to a cartridge count value $C_{MAX\text{-}C}=1.5\times10^2$.

Figure 7B:
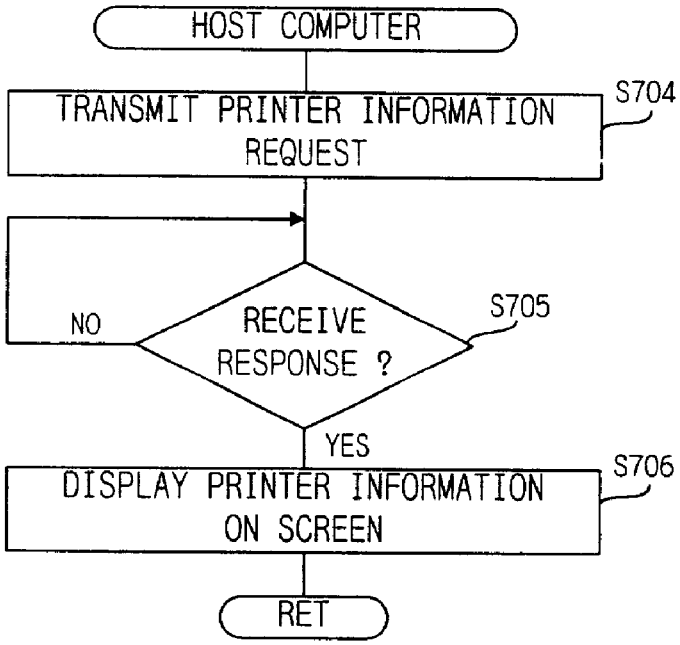
FIG. 7B is a flow chart showing an operation of a host computer of the embodiment.

Referring to FIG. 7B, the host computer 20 transmits the printer information request to the printer 10 (step S704) and then waits for printer information to be received (step S705). When receiving the printer information from the printer 10, the host computer 20 displays it on the monitor 21 (step S706). In this case, the host computer 20 receives a remaining ratio such as 0.98 or a remaining level such as "near-empty" which was calculated by the printer 10. For example, the ink level information such as "monochrome ink is near-empty" or "both monochrome and color ink are near-empty" is displayed on the monitor 21 of the host computer 20.

In the case of the color inkjet printer, the ink consumption memory 114 may store a monochrome ink consumption counter $C_{ACC\text{-}DW}$ and a color ink consumption counter $C_{ACC\text{-}C}$ for each color ink. Each ink consumption counter is controlled as described above. In this case, the communication process is similarly performed.

Figure 8A:
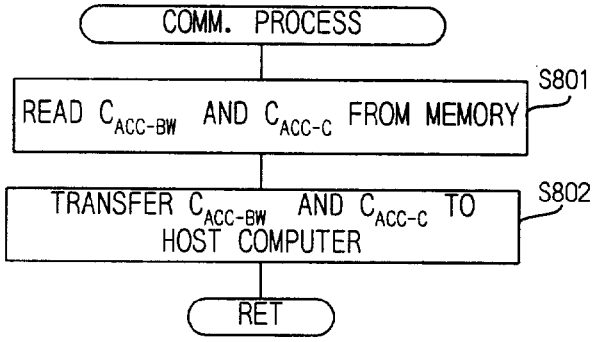
FIG. 8A is a flow chart showing a communication process of another embodiment according to the present invention.

Referring to FIG. 8A, when receiving a printer information request from the host computer 20, the printer controller 103 reads the monochrome ink consumption counter $C_{ACC\text{-}DW}$ and the color ink consumption counter $C_{ACC\text{-}C}$ from the memory 114 (step S801) and they are transferred to the host computer 20 (step S802).

Figure 8B:
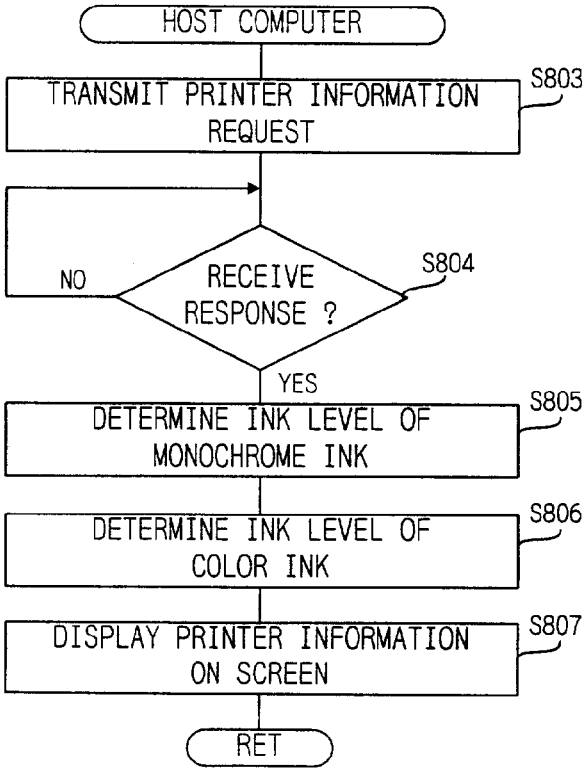
FIG. 8B is a flow chart showing an operation of a host computer of the other embodiment.

Referring to FIG. 8B, the host computer 20 transmits the printer information request to the printer 10 (step S803) and then waits for printer information to be received (step S804). When receiving the printer information from the printer 10, the host computer 20 determines the monochrome ink level by comparing the monochrome ink consumption counter $C_{ACC\text{-}DW}$ and the monochrome cartridge count value $C_{MAX\text{-}BW}$ (step S805). Similarly, the host computer 20 determines the color ink level by comparing the color ink consumption counter $C_{ACC\text{-}C}$ and the corresponding color cartridge count value $C_{MAX\text{-}C}$ (step S806).

When determining the monochrome and color ink levels, the host computer 20 displays them on the monitor 21 (step S807). In this case, the host computer 20 determines a remaining ratio such as 0.98 or a remaining level such as "near-empty". For example, the ink level information such as "monochrome ink is near-empty" or "both monochrome and color ink are near-empty" is displayed on the monitor 21 of the host computer 20.

Since the printer 10 is equipped with the display panel 112, the ink level information may be displayed on the display panel 112.

What is claimed is:

1. A method for detecting ink consumption in an inkjet printer having a print head with a plurality of nozzles selectively ejecting ink to a printing medium, comprising the steps of:

a) producing print image data indicating a pattern of ejection and non-ejection nozzles for ejecting or not ejecting dots of ink, respectively;

b) searching the print image data in blocks to count effective blocks, each including data indicating at least one ejection nozzle, wherein each block includes a predetermined dot matrix; and c) detecting ink consumption caused by a print operation based on a count of the effective blocks.

2. The method according to claim 1, wherein the step b) comprises the steps of:

dividing the print image data into a plurality of blocks each having the predetermined size; and counting effective blocks each including data indicating at least one ejection nozzle in the blocks.

3. The method according to claim 1, wherein each effective block has a predetermined ink consumption count value and the ink consumption caused by the print operation is detected by multiplying the count of the effective blocks by the predetermined ink consumption count value.

4. The method according to claim 1, further comprising the step of:

storing a first ink consumption count value corresponding to an effective block and a plurality of second ink consumption count values corresponding to ink consumption operations other than the print operation, respectively.

5. The method according to claim 4, wherein the step c) comprises the step of detecting a print ink consumption count value by multiplying the count of the effective blocks by the first ink consumption count value, the method further comprising the step of:

accumulating the print ink consumption count value and a second ink consumption count value corresponding to an ink consumption operation to produce total ink consumption of the inkjet printer when the print operation and the ink consumption operation are respectively performed.

6. The method according to claim 4, wherein the ink consumption operations include an ink suction operation for sucking ink from the nozzles and an ink pre-ejection operation for ejecting ink from the nozzles before printing.

7. The method according to claim 5, further comprising the step of:

storing a maximum ink count value corresponding to an ink capacity of an ink cartridge; and calculating an ink level of the ink cartridge by comparing the maximum ink count value to the total ink consumption.

8. The method according to claim 5, further comprising the step of:

transferring the ink consumption to a host computer connected to the inkjet printer in response to a request of the host computer;

at the host computer, calculating an ink level or the ink cartridge by comparing a maximum ink count value corresponding to an ink capacity of an ink cartridge to the total ink consumption.

9. The method according to claim 7, further comprising the step of:

transferring the ink level from the inkjet printer to a host computer in response to a request of the host computer.

10. An inkjet printer comprising:

a print head having a plurality of nozzles selectively ejecting ink to a printing medium;

a memory for storing an ink consumption count value corresponding to an ink consumption operation of the inkjet printer; and a controller for producing print image data indicating a pattern of ejection and non-ejection nozzle for ejecting or not ejecting dots of ink, respectively, searching the print image data in blocks effective blocks each including data indicating at least one ejection nozzle to count effective blocks, wherein each block includes a predetermined dot matrix, and detecting ink consumption caused by a print operation based on a count of the effective blocks.

11. The inkjet printer according to claim 10, wherein the controller divides the print image data into a plurality of blocks each having the predetermined size and counts effective blocks each including data indicating at least one ejection nozzle in the blocks.

12. The inkjet printer according to claim 10, wherein each effective block has a predetermined ink consumption count value and the controller detects the ink consumption caused by the print operation by multiplying the count of the effective blocks by the predetermined ink consumption count value.

13. The inkjet printer according to claim 10, wherein the memory stores a first ink consumption count value corresponding to an effective block and a plurality of second ink consumption count values corresponding to ink consumption operations other than the print operation, respectively.

14. The inkjet printer according to claim 13, wherein the controller detects a print ink consumption count value by multiplying the count of the effective blocks by the first ink consumption count value, and accumulates the print ink consumption count value and a second ink consumption count value corresponding to an ink consumption operation to produce total ink consumption of the inkjet printer when the print operation and the ink consumption operation are respectively performed.

15. The inkjet printer according to claim 13, wherein the ink consumption operations include an ink suction operation for sucking ink from the nozzles and an ink pre-ejection operation for ejecting ink from the nozzles before printing.

16. The inkjet printer according to claim 14, wherein the memory further stores a maximum ink count value corresponding to an ink capacity of an ink cartridge, and the controller calculates an ink level of the ink cartridge by comparing the maximum ink count value to the total ink consumption.

17. The inkjet printer according to claim 14, wherein the controller transfers the ink consumption to a host computer connected to the inkjet printer in response to a request of the host computer.

18. The inkjet printer according to claim 16, wherein the controller transfers the ink level from the inkjet printer to a host computer in response to a request of the host computer.

* * * * *